US010420445B2

(12) United States Patent
Bengtsson et al.

(10) Patent No.: US 10,420,445 B2
(45) Date of Patent: Sep. 24, 2019

(54) DISPENSER FOR DISPENSING A PAPER ROLL

(71) Applicant: SCA Hygiene Products AB, Göteborg (SE)

(72) Inventors: Mattias Bengtsson, Göteborg (SE); Tomas Gandemo, Göteborg (SE); Erik Hjort, Borlänge (SE); Stig Pommer, Borlänge (SE); Marcus Kullman, Borlänge (SE)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 0 days.

(21) Appl. No.: 15/775,138

(22) PCT Filed: Nov. 16, 2015

(86) PCT No.: PCT/EP2015/076671

§ 371 (c)(1),
(2) Date: May 10, 2018

(87) PCT Pub. No.: WO2017/084690

PCT Pub. Date: May 26, 2017

(65) Prior Publication Data

US 2018/0368630 A1 Dec. 27, 2018

(51) Int. Cl.
*A47K 10/38* (2006.01)
*A47K 10/32* (2006.01)

(52) U.S. Cl.
CPC ..... *A47K 10/3836* (2013.01); *A47K 10/32* (2013.01); *A47K 10/38* (2013.01);
(Continued)

(58) Field of Classification Search
CPC .... A47K 10/3836; A47K 10/32; A47K 10/38; A47K 2010/3863; A47K 2010/3253; A47K 2010/3206
See application file for complete search history.

(56) References Cited

U.S. PATENT DOCUMENTS 1,858,371 A * 5/1932 Lutz ..... B44C 1/145
242/423.1
2,411,293 A 11/1946 Roehner
(Continued)

FOREIGN PATENT DOCUMENTS

DE 102014006222 A1 11/2015
EP 2586349 A1 5/2013

OTHER PUBLICATIONS

Russian Office Action dated Jan. 23, 2019 issued in Russian patent application No. RU2018121823 (8 pages) and its English-language translation thereof (7 pages).

*Primary Examiner* — William A. Rivera
(74) *Attorney, Agent, or Firm* — Drinker Biddle & Reath LLP

(57) ABSTRACT

A dispenser includes: a housing having a support axis for accommodating and rotatably supporting the paper roll, a brake shoe having a contact surface configured to abut at a face side of the paper roll and movably attached relative to the housing for adjustment of a braking force, and an elastic member urging the brake shoe in a direction toward the face side of the paper roll and having an adjustable elastic force that adjusts the braking force. The contact surface may have at least a first contact area closer to a tip of the support axis in an axial direction of the support axis and further away from the support axis in a radial direction and a second contact area further away from the tip of the support axis in the axial direction and closer to the support axis in the radial direction to provide a braking force decreasing with a decreasing diameter of the roll.

15 Claims, 2 Drawing Sheets

(52) U.S. Cl.
CPC ..... *A47K 2010/3206* (2013.01); *A47K 2010/3253* (2013.01); *A47K 2010/3863* (2013.01)

(56) References Cited

U.S. PATENT DOCUMENTS

| | | | | | |
|---|---|---|---|---|---|
| 3,416,744 | A | | 12/1968 | Mott, Sr. et al. | |
| 3,685,761 | A | * | 8/1972 | Zelinski | A01K 89/003 242/129.7 |
| 4,179,077 | A | * | 12/1979 | Morishita | B41J 15/02 242/423 |
| 2006/0208130 | A1 | * | 9/2006 | Castor | A47K 10/38 242/598.3 |
| 2015/0374181 | A1 | * | 12/2015 | Morand | A47K 10/38 242/423 |

* cited by examiner

DISPENSER FOR DISPENSING A PAPER ROLL

CROSS-REFERENCE TO PRIOR APPLICATION

This application is a § 371 National Stage Application of PCT International Application No. PCT/EP2015/076671 filed Nov. 16, 2015, which is incorporated herein in its entirety.

TECHNICAL FIELD

The present disclosure relates to a dispenser for dispensing a paper roll, particularly a cylindrical paper roll, more particularly a tissue paper roll such as toilet paper, kitchen towels, etc.

BACKGROUND

Dispensers for dispensing a paper roll are well known in the art. For example EP 2 586 349 A1 discloses a dispenser having a housing for accommodating the paper roll and having a support axis for rotatably supporting the paper roll. Further, a brake shoe is provided having a contact surface abutting at a face side of the paper roll and inducing a brake force preventing rotation of the paper roll due to its rotational inertia after a desired length of a paper web has already been dispensed.

SUMMARY

Accordingly, it is desired to provide a dispenser, which enables a continuous and/or the simple adjustment of the braking force.

It is also desired to provide a dispenser, which provides for a braking force in dependency of the diameter of the roll, that is the dispensing state of the roll.

According to an aspect, a dispenser for dispensing a paper roll, particularly a cylindrical paper roll, is suggested. The paper roll may be a tissue paper roll. The dispenser includes a housing for accommodating the paper roll. The housing may be substantially closed to partially or completely capsule the paper roll and to substantially prevent the paper roll from being soiled or damaged. To access the paper roll, the housing may in this case include an access opening for accessing the paper roll or a tail end of the paper roll. However, the housing may as well be substantially open and more or less only support the paper roll for being unreeled. In either case, the housing has a support axis for rotatably supporting the paper roll. The support axis may be a fixed axis configured to support a paper roll having a core, for example made of cardboard. Alternatively, the axis itself may be rotatably connected to the housing supporting a so-called coreless roll. In this instance, the roll is generally force-fit on the support axis and rotates together with the support axis relative to the housing. Such coreless rolls are for example described in EP 1 782 722 A1.

Moreover, the dispenser has a friction brake. The friction brake includes a brake shoe having a contact surface in contact with a face side of the paper roll, if a paper roll is supported on the support axis. In order to enable adjustment of the braking force, the brake shoe is movably attached to the housing. According to one optional aspect, the distance of the brake shoe relative to the housing in the axial direction of the support axis (that is along the support axis) is always the same, if no roll is attached to the support axis independent of the adjusted braking force. Rather than changing the distance of the contact surface of the brake shoe to the face side of the roll along the support axis of the roll as in the prior art, an elastic member is suggested to urge the brake shoe in a direction toward the face side of the paper roll, that is along the axial direction of the support axis. The elastic force of the elastic member is adjustable to adjust the braking force. In other words, the braking force is adjustable by changing the elastic force with which the brake shoe or its contact surface is urged against the face side of the paper roll. As one particular example, the elastic member may be a spring, particularly a compression spring or a leg spring, the spring force of which can be adjusted to adjust the pretension of the spring thereby adjusting the braking force. Yet, the elastic member may also be an elastic pad or any other elastic element as long as the elastic force thereof may be adjusted, particularly by compressing and releasing the elastic element. Thus, the elastic member may be of any elastic material including metal and plastic. Accordingly, a simple system is suggested also enabling a continuous adjustment of the braking force, if desired.

Certainly, the dispenser may be configured to accommodate and support two or more rolls in which instance each roll may have its own and independent friction brake including the brake shoe. Even further, also two or more of the aforesaid friction brakes including the brake shoe may be provided for one roll, wherein the brake shoes or particularly their contact surfaces may contact opposite face sides of the roll, respectively.

In order to enable easy adjustment of the elastic force and reliability of the system, a support may be attached to the housing, the support being movable relative to the brake shoe and/or the housing. According to this aspect, the elastic member is interposed between the brake shoe and the support. This actually enables adjustment of the elastic force without the necessity to move the elastic member itself, whereby a reliable configuration is obtained.

Further, it is, according to this aspect, possible to adjust or change a distance between the support and the brake shoe, whereby the elastic force of the elastic member is adjusted. In other words, the elastic force may be increased by moving the support and the brake shoe closer to each other, because the elastic member is compressed, whereas the elastic force may be decreased by moving the support and the brake shoe away from each other releasing the elastic member to some extent.

According to one possible configuration, an adjuster is attached to the housing, the adjuster being movable relative to the support member. The adjuster further includes a ramp. The adjuster may, for example, be a disk having opposite surfaces. In an embodiment, the ramp is provided on a surface of the adjuster facing a rear surface of the support opposite to the brake shoe and facing the adjuster. The ramp is engaged with the support, particularly the rear surface of the support. As used herein, "engaged" encompasses a mere contact of a top surface of the ramp with the support, particularly its rear surface. The portion of the ramp, which engages with (contacts) the support or more particularly its rear surface, changes when the adjuster is moved. As the height of the ramp changes along its length, the distance between the adjuster or more particularly the surface of the adjuster having the ramp (and the housing) to the support changes and thereby also the distance between the support and the brake shoe. This is particularly assisted in that the movement of the brake shoe toward a face side of the paper roll is limited and the elastic member always urges the brake shoe in this end position (limit position), if no paper roll is attached to the support axis. Accordingly, the elastic force of the elastic member is adjustable by moving the adjuster. In particular, if a first height of the ramp engages with the rear surface of the support, a first distance between the support and the brake shoe can be realized and, hence, a first elastic force is obtained. If a second height lower than the first height of the ramp engages with the rear surface of the support, a second distance between the support and the brake shoe can be realized, which is increased compared to the first distance and, hence, the second elastic force is reduced as compared to the first elastic force.

According to one configuration, the ramp is annular or partially annular and the adjuster is rotatable relative to the support. Thereby, the adjustment can be simplified and the configuration can accommodate a relatively small installation space. In addition, this enables adjustment of the braking force using simple tools such as screwdrivers for rotating the adjuster.

According to one embodiment, the height of the ramp continuously increases from a minimum to a maximum. According to this aspect, the distance between the brake shoe and the support is smallest at the maximum height of the ramp and, hence, the elastic force is the largest. To the contrary, the distance between the brake shoe and the support is largest at the minimum height of the ramp and, hence, the elastic force is the smallest. By means of the continuous increase, any elastic force inbetween the maximum and the minimum can be obtained.

In one particular configuration, the adjuster may be rotated continuously, that is about more than 360°, wherein the engagement of the support with the ramp after having reached the maximum height either drops at a step to the minimum height or the ramp then again decreases from the maximum height to the minimum height. However, the continuous rotation enables ease of handling as the user does not need to elicit in which direction he has to rotate the adjuster.

In order to give an indication to the user that one or more of predetermined braking forces have been set, it may be useful to provide at least two notches in the ramp (particularly in the top surface of the ramp) which are engageable with a protrusion (particularly a protrusion disposed on the rear surface of the support) by rotation of the adjuster. If a user rotates the adjuster, a haptic feedback is given to the user, if a predetermined position of the adjuster has been reached, because the protrusion engages with the notch in this position. Further, a visual indicator may be provided on the adjuster or the brake shoe for visually indicating that a certain position has been reached.

In order to enable access to the adjuster, it may be advisable to provide a cutout in the brake shoe and the support, wherein the cutouts correspond to each other giving access to a manipulator for moving the adjuster. The manipulator may, for example, be provided with a recess (e.g. slot, crossed slot or Torx®) for engagement with a corresponding screwdriver.

In order to avoid tilting and, hence, to increase reliability of the friction brake, it may be advisable to pivotably attach the brake shoe and the support to the housing. As compared to a translational movement, which is also conceivable, a rotational movement avoids the brake shoe from being caught/getting stuck in the housing, thus improving reliability.

For ease of manufacture, it may even be advisable that the brake shoe and the support are pivotable about a common pivot axis.

Even further and in order to define (limit) the distance of the brake shoe relative to the housing (particularly its back wall or the wall to which the support axis is connected) along the axial direction of the support axis, the dispenser according to an aspect further includes a stop limiting the movement of the brake shoe in a direction toward the face side of the paper roll, for example about the aforesaid pivot axis of the brake shoe. In one particular embodiment, the brake shoe is always (independent of the set elastic force) urged by the elastic member into this limited position at which the distance of the brake shoe relative to the housing is maximum, when no roll is attached to the support axis.

Moreover, in order to enable a different brake force depending on the diameter of the paper roll, that is depending on the paper left on the paper roll or to put it differently depending on the dispensing state of the roll, a contact surface is suggested having at least a first contact area and a second contact area. The first contact area is closer to the face side of the roll, that is closer to a tip of the support axis as seen in an axial direction of the support axis. Further, the first contact area is further away from the support axis as seen in a radial direction, that is closer to the outer circumferential surface of the roll as seen in the radial direction. Accordingly, the braking force achieved by the first contact area is larger as it is more heavily pressed against the face side of the roll at an outer radial portion of the roll. The second contact area is further away from the tip of the support axis as seen in the axial direction of the support axis, particularly closer relative to the housing as seen in an axial direction. Further, the second area is closer to the support axis as seen in the radial direction, that is closer to the center axis of the roll as seen in a radial direction. As a distance between the second contact area and the housing (that part of the housing to which the support axis is connected) is smaller than the distance between the first contact area and the housing, the braking force applied by the second contact area is smaller, because the second contact area is less heavily pressed against the face side of the roll. Accordingly, and as the diameter of the roll diminishes during dispensing, the face side of the roll, for example at some stage, only contacts with the second contact area of the contact surface so that the braking force applied thereby is smaller than that applied when the diameter of the roll is larger and less paper has been dispensed.

In order to have a continuous contact surface with the two or more contact areas, it may be preferred that the contact surface is a planar plane tilted relative to the support axis at an angle different than 90° to achieve a different distance of the two or more contact areas. Alternatively, it is conceivable that the contact surface is an angled or curved plane.

As used herein, the term "comprises," "comprising," and other derivatives from the root term "comprise" are intended to be open-ended terms that specify the presence of any stated features, elements, integers, steps or components, but do not preclude the presence or addition of one or more other features, elements, integers, steps, components or groups thereof. Accordingly, such terms are intended to be synonymous with "has," "have," "having," "includes," "including," and any derivatives of these words.

Further features, effects and advantages which may be implemented either alone or in combination with one of the aforesaid features are described referring to an embodiment illustrated in the accompanying drawings.

DESCRIPTION OF PARTICULAR EMBODIMENTS

Figure 1:
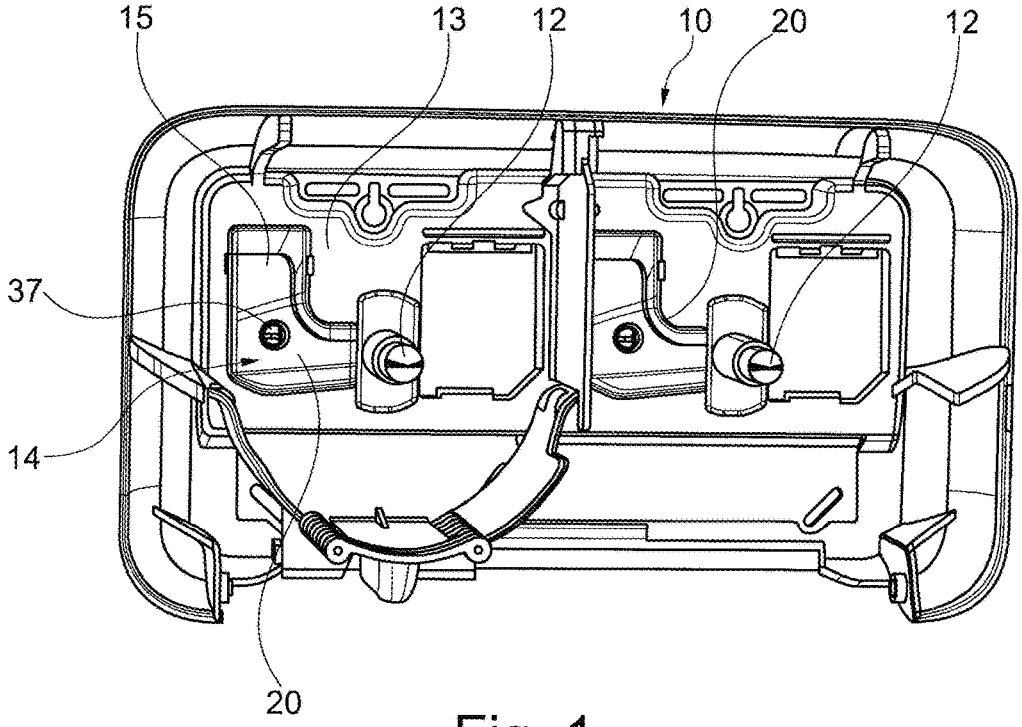
FIG. 1 shows a perspective front view of a dispenser with a lid being removed to reveal the interior.

The dispenser shown in FIG. 1 includes a housing 10 and is configured to accommodate two not shown paper rolls, particularly two tissue paper rolls such as toilet paper rolls. For this purpose, the housing 10 has two support axes, one for each roll. In the present embodiment, the support axes are rotatably attached to the housing 10, particularly to a back wall 13 of the housing 10. Thus, the present dispenser is configured to accommodate coreless rolls as those described in EP 1 782 722 A1, which are frictionally engaged with the support axis 12 at their center axis so as to be held by the support axis 12 and to rotate together with the support axis 12.

The dispenser further includes a friction brake 14 for each roll. As the friction brakes 14 have the same configuration, only one of these brakes is described in the following.

Figure 2:
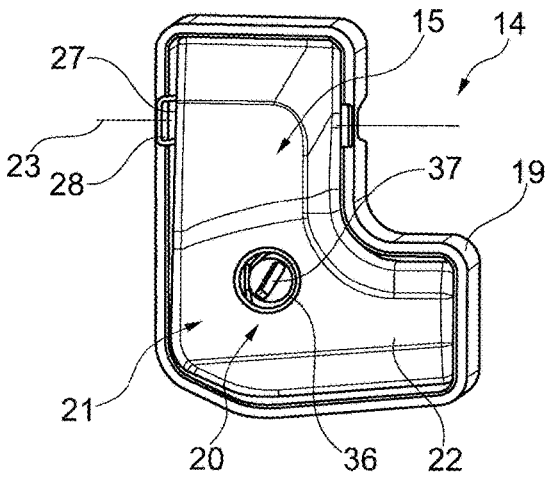
FIG. 2 shows a perspective front view of a friction brake of the dispenser shown in FIG. 1.
Figure 3:
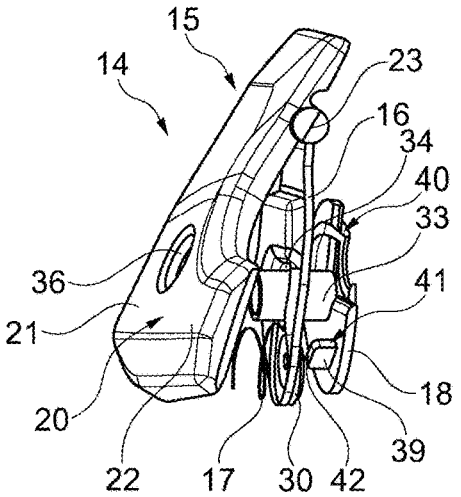
FIG. 3 shows a perspective a side view on the friction brake of FIGS. 1 and 2.

The friction brake 14 is disposed on the back wall 13 of the housing 10. The friction brake 14, which is shown in an enlarged front view in FIG. 2 and a perspective side view in FIG. 3, includes a brake shoe 15, a support 16, an elastic member 17 (in the present embodiment a compression spring) and an adjuster 18. These elements are assembled to a body 19, which, in turn, is fixed to a corresponding recess 20 in the back wall 13 of the housing 10. Thus, the friction brake 14 may be preassembled and in the assembled state be inserted into the recess 20 of the housing 10 thereby being attached to the housing 10. On the other hand, the recess in the housing may also directly receive the brake shoe 15, the support 16, the elastic member 17 and the adjuster 18 without the need of a body 19. Alternatively, the pre-assembled friction brake may be attached on a surface of the back wall 13 of the housing 10 omitting the recess 20.

The brake shoe 15 has a contact surface 20, which is a planar plane being tilted relative to the support axis 12 in the axial direction at an angle different than 90° in a radial direction. Thereby the contact surface 20 has a first contact area 21 and a second contact area 22. The contact surface 20, thus, has a distance as seen in an axial direction of the support axis 12 to the back wall 13 of the housing which continuously decreases from the first contact area 21 to the second contact area 22. Thus, the distance continuously decreases in a radial direction toward the support axis 12. The distance of the contact surface 20 to the back wall 13 of the housing 10 is smallest closest to the support axis 12 and largest furthest away from the support axis 12 in a radial direction. Accordingly, the first contact area 21 is closer to the tip of the support axis 12 as seen in an axial direction than the second contact area 22, which is closer to the connection of the support axis 12 to the back wall 13 of the housing. As a consequence, if a paper roll is attached to the axis 12, the first contact area 21 presses more onto a face side of the roll than the second contact area 22. The more paper is unreeled from the paper roll, the smaller its diameter becomes. Accordingly, once the roll is unreeled, the contact between the face side of the roll and the first contact area 21 reduces and at some stage the face side of the roll will no longer be in contact with the first contact area 21 but only in the second contact area 22 or a part thereof. Accordingly, the braking force applied to the face side of the paper roll in the present case gradually and continuously reduces with unreeling of the roll due to the continuous decrease of the distance of the contact surface 20 to the face side of the paper roll. Hence, the braking force applied is dependent on the diameter of the roll or the dispensing state of the roll. In an alternative embodiment, it may well be that instead of a tilted planar plane of the contact surface 20 an angled or curved plane is used to have a more stepwise change in the braking force in dependency of the diameter of the roll.

Figure 4:
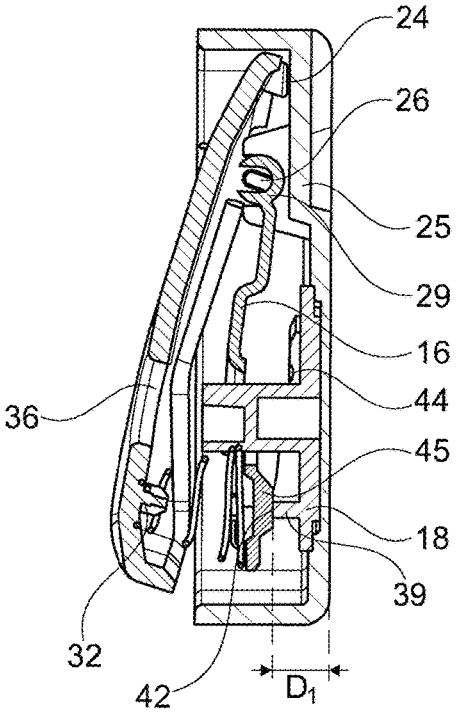
FIG. 4 shows a side section of the friction brake as shown in FIGS. 1 to 3 with a first elastic force of the elastic member being set.
Figure 5:
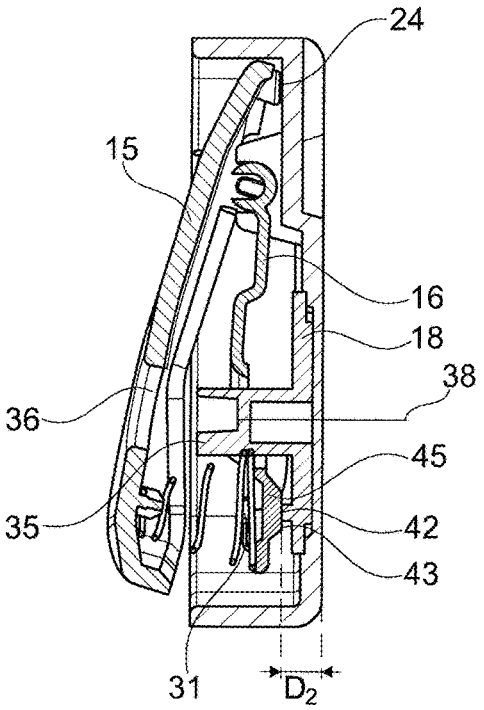
FIG. 5 shows a side section of the friction brake as shown in FIGS. 1 to 3 with a second elastic force of the elastic member being set.

As can be best seen from FIGS. 2 to 5, the brake shoe 15 is rotatably attached to the body 19 and, hence, the housing 10 about an axis of rotation 23. The contact surface 20, which is disposed at an end of the brake shoe away (most distant) from the axis of rotation 23, can accordingly be moved further away from the body 19 or the back wall 13 of the housing 10 and closer to the body 19 or the back wall of the housing 10 by rotation about the axis of rotation 23. Further, the brake shoe 15 has a stop 24 for limiting the rotational movement of the brake shoe 15 about the axis of rotation 23 at an end opposite to the end at which the contact surface 20 is located. The stop 24 is, hence, relative to the axis of rotation 23 disposed on another side of the brake shoe 15 than the contact surface 20. The stop 24 abuts at a back wall 25 of the body 19 or may in other cases abut at the back wall 13 of the housing 10 in the maximum position (end or limit position) at which the contact surface 20 is most distant from the back wall 13 of the housing 10 or a back wall 25 of the body 19. If no roll is inserted into the dispenser, the brake shoe 15 will always be in the maximum position as shown in FIGS. 4 and 5 being urged into this position by the elastic member 17. If a roll is inserted, the face side of the roll is pressed against the contact surface 20 and thereby pushes the brake shoe toward the back wall 25 about the axis of rotation 23 against the elastic force of the elastic member 17.

The support 16 of the friction brake 14 is also rotatably attached to the body 19 (and/or the housing 10) about the same axis of rotation 23 as the brake shoe 15. For ease of assembly, it may be advantageous that the brake shoe 15 has a fixed axis 26 having heads 27 at opposite ends clicked into corresponding recesses 28 in the body 19 (these could also be in the housing 10) and the support 16 has an engagement portion 29 clicked onto the axis 26 as shown in FIGS. 4 and 5.

Moreover, the support 16 has a support portion 30 at an end furthest away from the axis of rotation 23 and corresponding to the contact surface 20 or at least the end of the brake shoe 15 adjacent the contact surface 20. The support portion 30 is configured for supporting the elastic member 17. In a particular embodiment, the support portion 30 includes a plurality of hooks 31 engaging with the elastic member 17 to form fittingly attach the elastic member 17 to the support 16. Similarly, the brake shoe 15 may, at its surface facing the support 16, have a support structure 32, here a protrusion inserting into an end of the elastic member 17, thus guiding and holding this end of the elastic member 17.

The adjuster 18 is a rotatable disk rotatably attached to the body 19 or more particularly to the back wall 25 of the body 19. Alternatively, the adjuster may as well be attached to the housing 10 or to its back wall 13. A protrusion 33 (manipulator) is provided on a surface of the adjuster 18 facing the support 16. The protrusion extends through a cutout 34 in the support 16 and a tip 35 of the protrusion 33 is accessible through a further cutout 36 in the brake shoe 15, here in the contact surface 20. The tip 35 further includes a slot 37 for inserting a slotted screwdriver. Accordingly, one can rotate the adjuster 18 about its rotation axis 38 using a slotted screwdriver, if no roll is inserted and as will be apparent from FIG. 1. Certainly, other recesses than the slot 37 such as a crossed slot or Torx® may be implemented.

Further, the adjuster 18 includes a ramp 39 on its surface facing the support 16. The ramp 39 is partially annular with a first height starting at a first end 40 and continuously increasing to a second height at a second end 41 of the ramp 39. A top surface 42 is in contact with a surface (rear surface) of the support 16 facing the top surface 42 of the ramp 39. Accordingly, a distance (later referred to as D1 and D2) between the surface 43 of the support 16 and the back wall 25 of the body 19 or respectively the housing 10 (particularly its back wall 13) is different depending on which portion of the ramp 39 or particularly its top surface 42 engages (contacts) with the surface 43. Accordingly and as previously explained, the brake shoe 15 is always in the maximum tilted position with the stop 24 abutting the back wall 25 of the body 19, if no roll is inserted. Thus, if a portion of the top surface 42 of the ramp 39, being for example close to or at the end 41, engages with the surface 43, a distance D1 between the surface 43 and the back wall 13 of the housing 10 is relatively large (see FIG. 4). As the brake shoe 15 may not move or rotate further away from the back wall 13, the elastic member 17 is more compressed, because the distance between the rear surface of the brake shoe 15 facing the support 16 and the front surface of the support 16 facing the brake shoe is reduced. Accordingly, the elastic member 17 urges the brake shoe 15 or more particularly the contact surface 20 toward a face side of the roll with a higher elastic force, if a roll is inserted, and pushes the brake shoe 15 about the axis of rotation 23. Accordingly, the braking force applied to the face side of the roll is relatively large.

If a user, however, rotates the adjuster 18 by using the screwdriver being inserted into the slot 37 counterclockwise or clockwise, the portion of the top surface 42 engaging with the surface 43 changes. If one changes, for example to a portion of the ramp 39 adjacent or close to the end 40, the distance D2 between the surface 43 and the back wall 13 of the housing 10 is smaller as compared to the distance D1 (see FIG. 5). Accordingly, also the distance between the rear surface of the brake shoe facing the support 16 and the front surface of the support 16 facing the brake shoe 15 increases. As a result, the elastic member 17 is relieved as compared to the case in FIG. 4 and the elastic force applied to the brake shoe 15 is decreased. Accordingly, the braking force applied to the face side of the roll is smaller than that of FIG. 4.

Because the ramp 39 is continuous, the braking force may continuously be adjusted or more particularly the elastic force of the elastic member 17 may continuously be adjusted.

Further, it is beneficial that the adjuster 18 may be rotated about more than 360°, thereby enabling a user to not need to consider in which direction he/she would need to rotate. In this context, it was, however, beneficial that the ramp 39 is completely annular so that a rotation in both directions is possible in all positions.

In addition, it may be possible, even though not shown, that indicia are provided on the contact surface 20 of the brake shoe 15 near the cutout 36 to visually indicate to the user that a maximum or minimum brake force is set.

To also provide a haptic feedback that a certain position or certain brake force has been reached, two or more notches 44 formed in the top surface 42 of the ramp 39 may be provided. It may, in this case, also be preferred that the surface 43 of the support 16 is part of a rib 45 (or more general a protrusion) extending from the rear surface of the support 16 toward the top surface 42 of the ramp and being in its width adapted to the width of the notches 44. When rotating the adjuster 18 and a certain position is reached, the rib 43 engages with the notch 44, thereby giving a haptic feedback to the user that a certain position has been reached.

By the afore-described embodiment, it is possible to provide a dispenser having a friction brake 14, wherein the braking force applied to a roll decreases with a decreasing roll diameter upon unreeling the roll, because of the contact surface 20 having the contact areas 21 and 22 applying different braking forces to different diameter portions of the roll.

Further, it is possible to continuously adjust the braking force by adjusting the elastic force of the elastic member. This adjustment is achieved by a reliable and simple configuration and at the same time securing ease of handling.

Certainly, the present embodiment may be altered. For example, it is conceivable to use an adjuster 18 which is translationally movable relative to the housing or the body with a linear ramp. It is also conceivable to use translationally movable brake shoes and adjusters. In the same manner, it is conceivable to directly attach the parts of the friction brake 14 to the housing without the use of the body 19. Even further alterations may be performed without departing from the scope of the invention as defined in the claims.

The invention claimed is:

1. A dispenser for dispensing a paper roll, comprising:

a housing for accommodating the paper roll and having a support axis for rotatably supporting the paper roll;

a brake shoe having a contact surface configured to abut at a face side of the paper roll, the brake shoe being movably attached relative to the housing for adjustment of a braking force; and an elastic member urging the brake shoe in a direction toward the face side of the paper roll, so that the brake shoe is pushed by the face side of the paper roll toward the housing about the axis of rotation against an elastic force of the elastic member pushing against a surface of the brake shoe opposite the contact surface, wherein the elastic force of the elastic member is adjustable to adjust the braking force.

2. The dispenser according to claim 1, further comprising a support attached relative to the housing and being movable relative to the brake shoe, the housing, or both, wherein the elastic member is interposed between the brake shoe and the support.

3. The dispenser according to claim 2, wherein a distance between the support and the brake shoe is adjustable to adjust the elastic force of the elastic member.

4. The dispenser according to claim 2, further comprising an adjuster attached relative to the housing and being movable relative to the support, the adjuster comprising a ramp engaged with the support, wherein a portion of the ramp engaged with the support is changeable by movement of the adjuster relative to the support, thereby changing a distance between the housing and the support and between the support and the brake shoe.

5. The dispenser according to claim 4, wherein the ramp is at least partially annular and the adjuster is rotatable relative to the support.

6. The dispenser according to claim 4, wherein the height of the ramp continuously increases from a minimum to a maximum.

7. The dispenser according to claim 4, wherein at least two notches are formed in the ramp, the notches being engageable with a protrusion by rotation of the adjuster indicating a predetermined braking force.

8. The dispenser according to claim 4, wherein the brake shoe and the support have a corresponding cutout giving access to a manipulator for moving the adjuster.

9. The dispenser according to claim 2, wherein the brake shoe and the support are pivotably attached to the housing.

10. The dispenser according to claim 9, wherein the brake shoe and the support are pivotable about a common pivot axis.

11. The dispenser according to claim 1, wherein movement of the brake shoe in a direction toward the face side of the paper roll is limited by a stop engaging relative to the housing.

12. The dispenser according to claim 1, wherein the contact surface of the brake shoe has at least a first contact area closer to a tip of the support axis as seen in an axial direction of the support axis and further away from the support axis as seen in a radial direction and a second contact area further away from the tip of the support axis as seen in the axial direction of the support axis and closer to the support axis as seen in the radial direction.

13. The dispenser according to claim 1, wherein the elastic member is a compression spring, a leg spring, or an elastic pad.

14. A dispenser for dispensing a paper roll, comprising:

a housing for accommodating the paper roll and having a support axis for rotatably supporting the paper roll, a brake shoe having a contact surface configured to abut at a face side of the paper roll, wherein the contact surface of the brake shoe has at least a first contact area closer to a tip of the support axis as seen in an axial direction of the support axis and further away from the support axis as seen in a radial direction and a second contact area further away from the tip of the support axis as seen in the axial direction of the support axis and closer to the support axis as seen in the radial direction, wherein the brake shoe is rotatably attached to the housing about an axis of rotation and the first contact surface and the second contact surface are disposed an equal distance from the axis of rotation.

15. The dispenser according to claim 14, wherein the contact surface is an angled or curved plane or a planar plane tilted at an angle to the support axis different to 90° to form the first contact surface and the second contact surface.

* * * * *